US007614513B2

(12) United States Patent
Anderson

(10) Patent No.: US 7,614,513 B2
(45) Date of Patent: Nov. 10, 2009

(54) INNER CONTAINER ATTACHABLE TO PRIMARY CONTAINER CAP

(75) Inventor: Michael R. Anderson, Arroyo, CA (US)

(73) Assignee: Andeboh Holdings, FLP, Carson City, NV (US)

( * ) Notice: Subject to any disclaimer, the term of this patent is extended or adjusted under 35 U.S.C. 154(b) by 144 days.

(21) Appl. No.: 11/470,398

(22) Filed: Sep. 6, 2006

(65) Prior Publication Data

US 2007/0051689 A1 Mar. 8, 2007

Related U.S. Application Data

(60) Provisional application No. 60/596,184, filed on Sep. 7, 2005.

(51) Int. Cl.
*B65D 25/04* (2006.01)
*B65D 1/04* (2006.01)

(52) U.S. Cl. ..... 215/10; 215/6; 220/506; 220/522; 220/526

(58) Field of Classification Search ..... 220/23.87, 220/521, 522, 528, 527, 526, 506; 215/10, 215/6

See application file for complete search history.

(56) References Cited

U.S. PATENT DOCUMENTS 2,352,951 A * 7/1944 Geria ..... 126/263.05
3,870,147 A * 3/1975 Orth ..... 206/222
4,024,052 A * 5/1977 Antos ..... 208/139
4,319,614 A * 3/1982 Boice ..... 141/381
4,618,444 A * 10/1986 Hudson et al. ..... 8/111
4,720,351 A * 1/1988 Flynn et al. ..... 510/277
5,502,981 A * 4/1996 Sullivan ..... 62/372
5,593,052 A * 1/1997 McGee ..... 215/11.1
5,813,563 A * 9/1998 Boehm et al. ..... 220/522
5,950,819 A * 9/1999 Sellars ..... 206/221
6,386,358 B1 * 5/2002 North et al. ..... 206/217
7,159,741 B2 * 1/2007 Dehn et al. ..... 222/83.5
2003/0205548 A1 * 11/2003 Seckler ..... 215/11.1
2006/0102581 A1 * 5/2006 Yates, III ..... 215/6
2006/0213857 A1 * 9/2006 Chen et al. ..... 215/11.1

* cited by examiner

*Primary Examiner*—Anthony Stashick
*Assistant Examiner*—Niki M Eloshway
(74) *Attorney, Agent, or Firm*—Malin Haley DiMaggio Bowen & Lhota, P.A.

(57) ABSTRACT

A primary container (PC) cap or closure that includes a separate fastener for a separate inner container (IC). A liquid, powder or crystal is stored in the inner container ready for use. One purpose of the invention is to provide two separate containers mounted together with different ingredients for admixture at the time of use. This increases the shelf-life of the combined products.

1 Claim, 5 Drawing Sheets

10

FIG. 8
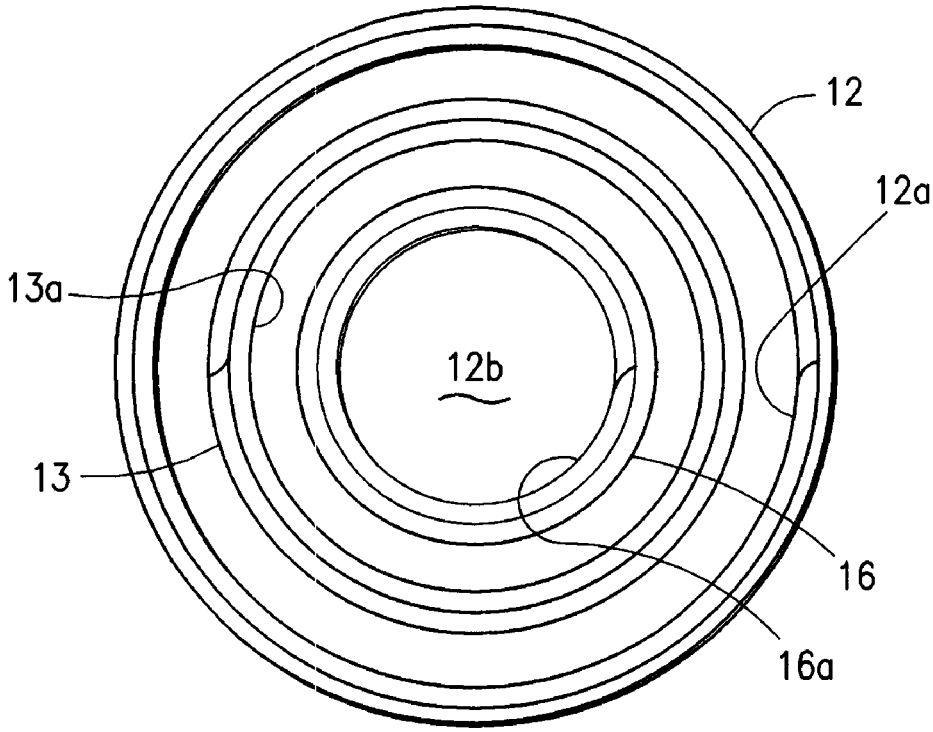
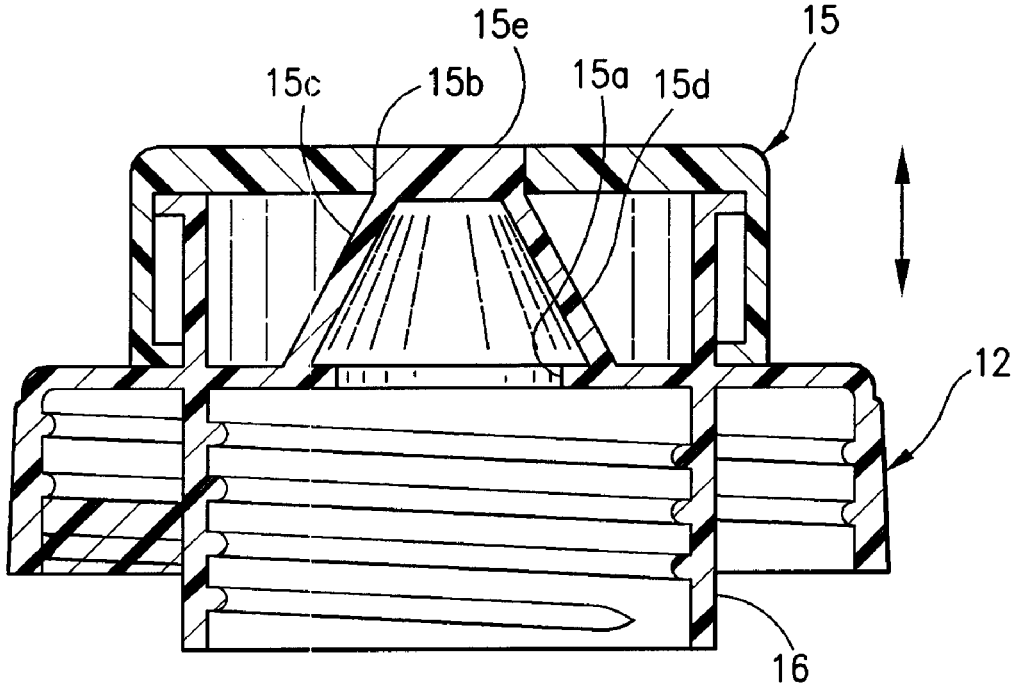
FIG. 9

INNER CONTAINER ATTACHABLE TO PRIMARY CONTAINER CAP

BACKGROUND OF THE INVENTION

1. Field of the Invention

One embodiment of the invention relates to a liquid and/or dry ingredient inner container that is releasably and sealably attached to the cap or closure of a primary container. The inner container stores liquid and/or dry substances which can be rapidly dispensed into the primary container by manual actuation when desired simply by removing the primary container cap and detaching the inner container from the primary container cap. The inner container may be pre-mounted in the primary container at a factory or used with a primary existing container that has the improved cap.

2. Description of Related Art

Many food, drugs, cosmetics, adhesives, polishes, cleansers, dyes and other substances are frequently supplied in a liquid, powder or crystal form and do not retain their stability, strength and effectiveness for long after the ingredients have been mixed in solution or suspension. This incompatibility after mixing, therefore, mandates that the mixed product be utilized relatively soon after mixture to prevent deterioration, discoloration, interactions and the like. It is also important that admixtures of various ingredients be done under conditions wherein a measured amount of one chemical ingredient is added to a measured amount of another chemical to ensure that proper results are obtained.

Another concern involves merchandizing of certain products. Frequently two or more companion products are supplied to the consumer in a single package. Thus, many products are by their very nature required to be used by the consumer shortly after the products are manufactured as the chemicals may lose certain desirable characteristics within a short period of time. The admixed products can be individually stored for extended periods of time if one ingredient is maintained separate from the other. In such case, the two ingredients may be mixed together to form the desired products shortly before use. In marketing such goods, it obviously is desirable that both ingredients be sold as part of the same package.

SUMMARY OF VARIOUS EMBODIMENTS

A primary container cap that includes fasteners for a primary container and a separate inner container.

An inner container for containing liquids and/or powder materials or both has substantially a liquid impervious body that can include a closed bottom and an open top and is attachable to the primary container cap. A primary container (PC) cap that is used to seal a conventional primary container such as a bottle that contains a liquid or a powder includes typically a threaded portion on the inside wall for threadably attaching the primary container cap sealably to the top opening of a threaded primary container that has threads around the upper neck. The PC cap also includes a separate inner circular wall that also has threads on the inside of the wall and that has an inside diameter that fits snuggly with the outside threaded diameter of the inner container which can be screwed tightly and connected and sealed to the PC cap.

The inner container body that includes an open top with threads for fastening to the PC cap can be filled with a liquid or powder or both and then sealably tightened and screwed into the PC cap. The contents of the inner container are sealed. There is enough space between the outer wall of the inner container body and the inside wall of the PC cap that allows the IC body to be inserted into a primary container that itself may be filled with a liquid or powder and tightly sealed with the PC cap.

In an alternate embodiment, the inner container body open end could have an annular flange or enlarged ring around its perimeter. In this case, the PC cap includes an interior cylindrical raised wall that (in lieu of threads) attaches to the top flange of the inner container with a pair of resilient parallel annular raised ridges forming a groove to receive the inner container open end flange as a snap-in/snap-out tight fit. The IC body top flange is popped into place sealing the IC body to the PC cap between the joint annular ridges in the interior circular wall connected to the bottom side of the PC cap. In this case, after the IC body is filled with a desired liquid or powder (or both) to be added into the primary container at the time of use, the IC body is popped and sealed to the PC cap. The primary container is filled with a desirable liquid or powder for future consumption. The PC cap can be screwed and sealed tightly onto the primary container. The primary container can be a bottle, can, or any other suitable receptacle for holding a liquid or powder or gel to be mixed with another substance.

Having disclosed a preferred embodiment with the threaded fasteners for the IC and PC and an alternate embodiment with the snap-in flange for the IC, there may be other container fasteners to sealably but removably affix the IC body to the inside of the PC cap.

In one embodiment, the inner container is an elongated tube. In other embodiments, the IC body could be, in fact, different shapes and could be square, octagonal or any other suitable shape that is smaller in cross-sectional area and diameter than the inside neck opening of the PC that the IC is placed in. The IC length can be varied to extend the whole length of the PC or a very short length if desired depending on the volume of the inside material to be dispensed. The IC body can be made of any standard plastic or glass or other suitable material that is gas and liquid impervious and useful for sealing a product in a stored condition while the IC body is attached to the PC cap. The primary container and PC caps can be of different design and construction as long as they effectively seal a primary container with the removable cap that would allow access and attachment of the inner container to the PC cap.

The IC utilized in one embodiment of the present invention can contain powder and/or liquid, tablets, pills, crystalline substances for introduction into the contents of the PC within which the IC is housed. The IC may have one or more chambers which include a divider for liquid and/or powder. The PC within which the IC is installed and housed may also have one or more dividers for liquid and powder.

The PC cap can be flat, closed or include a closable nipple for drinking. The PC cap is a removable cap typically fastened on a PC neck opening.

Any type of conventional primary container that can contain a liquid or a powder can be used with the present invention. A membrane or sack may be used for the inner container. The conventional container cap is modified to allow the attachment thereto by any suitable fastener of the dispensing IC. In this manner, once the cap or closure of the PC is removed, exposing the dispensing inner container which is then removed from the primary container, then the dispensing inner container itself can be quickly and easily manually removed from the primary cap or closure, allowing one to dispense whatever material, liquid or powder or both, is in the inside the inner container. The primary container can be basically any size or shape and will typically have a liquid impervious body so that the primary container can hold liquids without leakage. Likewise, the inner container that is mounted inside the primary container until ready for use can be any size or shape as long as the inner container can fit within the cap or closure portion of the primary container.

A primary container could have two openings and have two removable caps, one that has the dispensing IC mounted thereto and a separate conventional cap that can be used to pour liquid or powder from the primary container. This would require more than one opening in the primary container body.

The PC caps themselves for connection to the primary containers can have differences that can be threaded or snapped onto the primary container opening as can the dispensing IC which can be threaded, snapped or even tetra-Pak style connection to the PC cap or closure.

The PC cap can be constructed to have two or more circular threaded or snap on fastening walls molded with the PC cap of different diameters circumferentially disposed to receive two separate inner containers coaxially mounted of different diameters either separately or together. The PC cap can also be made to have a nipple closure that includes a hole through the cap for drinking. Once the inner container is removed from the nipple cap and the contents dispensed into the PC and the inner container discarded, the nipple PC cap can be returned to the PC and used conventionally.

The IC need not have some type of additional foil seal across the top although it could have if required because of the materials, liquid or powder, stored therein. But in a preferred embodiment, there will be a sufficient liquid and air seal when the dispensing IC is screwed tightly onto the PC cap that an air and liquid seal is present, sealing the contents within the dispensing IC from leaking while connected to the PC cap. The IC/PC cap seal is also envisioned in any other type of connection between the dispensing IC and the PC cap so that the materials in each container are separated and are sealed without the need for an inner additional foil seal over the dispensing IC open end. The IC in one embodiment is shaped tubularly and looks much like a small test tube. However, the IC can have any shape as long as the IC fits within the PC. The IC could also be constructed from any standard plastic, metal, cardboard, tetra-Pak style, wood, ceramic or any other suitable material for being liquid impervious and for sealing a product in a stored condition while attached to the PC cap or any of type of closure.

Even if a new type of container closure were to be invented that is not envisioned at this point in time, in one embodiment the primary container cap can still provide for an inner container to be sealably attached to the inside of the new closure for a primary container.

Once the inner container has been removed from the primary container cap and the IC contents disposed into the PC, the IC can be either thrown away or could be recapped and reattached to the PC cap of the PC and disposed of as a unit with the PC cap. The two containers, inner and primary, could be returned to a recycle recovery unit.

It is an object of this invention to provide a primary container cap attachable to an insertable inner container that can include ingredients that can be readily dispensed into a primary container at a desired time and, thus, not interfere with the shelf life or physical chemical integrity of the ingredients to be combined.

It is an object of this invention to provide a liquid or dry ingredient storing inner container that includes a removable feature and that can be attached to a primary container cap and stored inside the primary container until ready for use in which the inner container ingredients can be added to the PC ingredients.

In accordance with these and other objects which will become apparent hereinafter, the instant invention will now be described with particular reference to the accompanying drawings.

BRIEF DESCRIPTION OF THE DRAWINGS

FIG. 8 shows a bottom plain view of the primary container cap disclosing an alternate embodiment of the invention.

FIG. 9 shows yet another alternate embodiment of the invention in a side elevational view in cross-section of the primary container cap that can be used to drink from the primary container after the inner container is removed.

DETAILED DESCRIPTION

Figure 1:
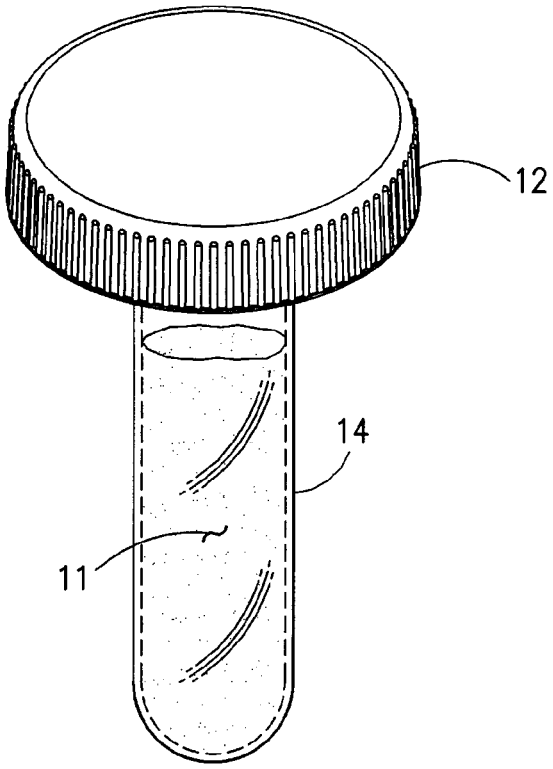
FIG. 1 is a perspective view of the invention that includes a primary container with a fastener for an inner container.
Figure 2:
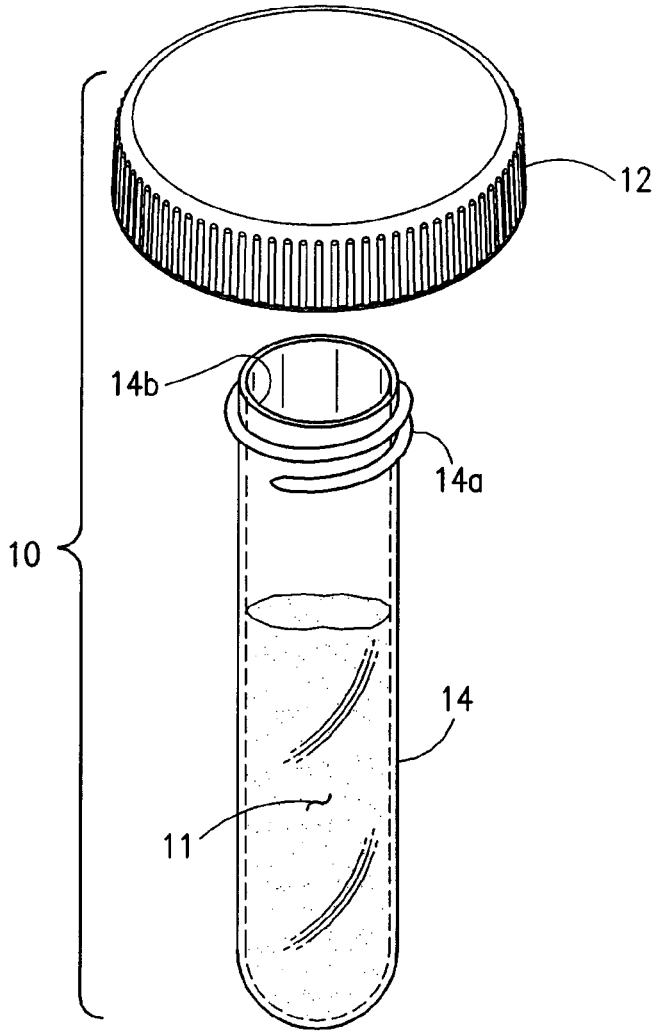
FIG. 2 shows an exploded view of the primary container cap removed from the inner container that can store a chemical or ingredients.

Referring now to the drawings and, in particular, FIGS. 1 and 2, an embodiment of the invention is shown generally at 10 comprised of a primary container bottle cap 12 which is used to cover the opening and seal a conventional container that can contain a liquid, powder or crystal substance. A primary container is not shown in FIGS. 1 and 2. An inner container 14 (preferably impervious to water or other liquid and air) is attached to primary container cap 12 in FIG. 1 and has a chemical ingredient 11. As shown in FIG. 1, the tubular body 14 is sealably connected and attached to the inside of bottle cap 12.

Figure 3:
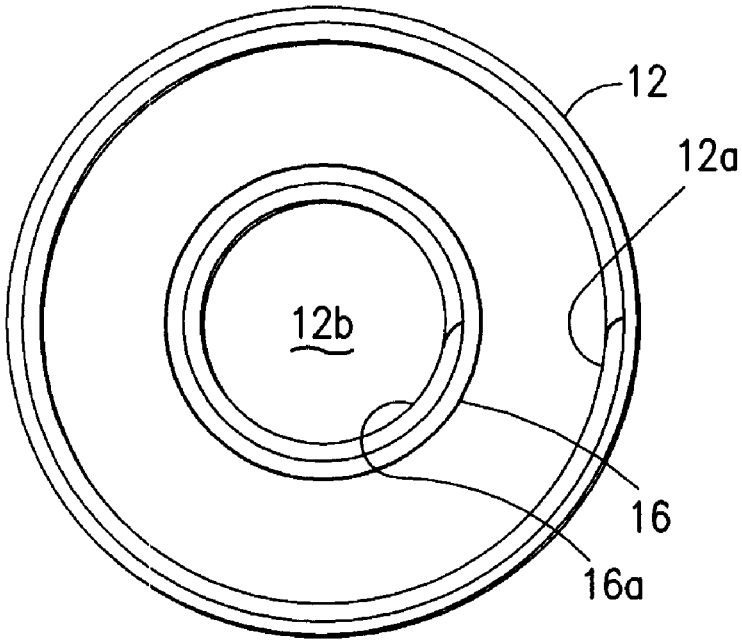
FIG. 3 shows a bottom plan view of a primary container cap in accordance with an embodiment of the invention.

Referring now to FIGS. 2 and 3, the primary container cap 12 is shown removed from the inner container tubular body 14. Tubular body 14 includes an open top 14*b* that is surrounded by fastener threads 14*a* formed as part of the body 14 for fastening the tubular body 14 to the bottle cap 12, using the threaded fasteners 14*a*. As shown in FIG. 3, the primary container cap 12 on the inside surface has a first circular wall that includes fastener threads 12*a* that are attachable to the upper neck of a threaded primary container for sealable attachment. The primary container cap 12 also includes a second inside circular wall 16 that is raised above the bottom surface 12*b* of the cap 12 by a sufficient distance for attachment to the tubular body 14 shown in FIGS. 1 and 2 along upper opening 14*b*. The inner wall 16 could be at least a half an inch in height, circular and on its inside wall 16*a* including a plurality of threads 16*a* for fastening to the tubular body 14 as shown in FIG. 2 to threads 14*a* so that the tubular body 14 can be sealably but removably fastened to the cap 12 by the inner wall 16 and threads 16*a*.

Figure 4:
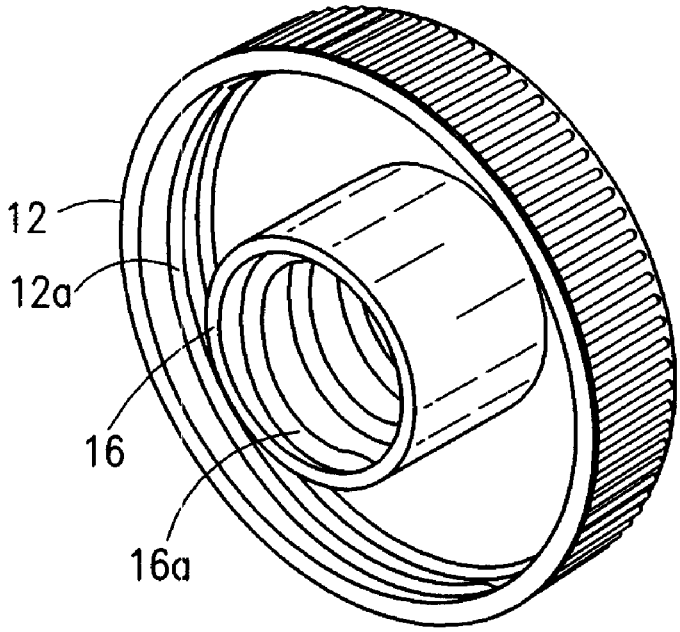
FIG. 4 shows a perspective bottom view of a bottle cap in accordance an embodiment of the invention.

FIG. 4 shows primary container cap 12, inner wall 16, the inner wall threads 16*a* and primary container cap threads 12*a*. Note that the inner cap 16 outer length exceeds that of primary cap 12 rim.

Figure 5:
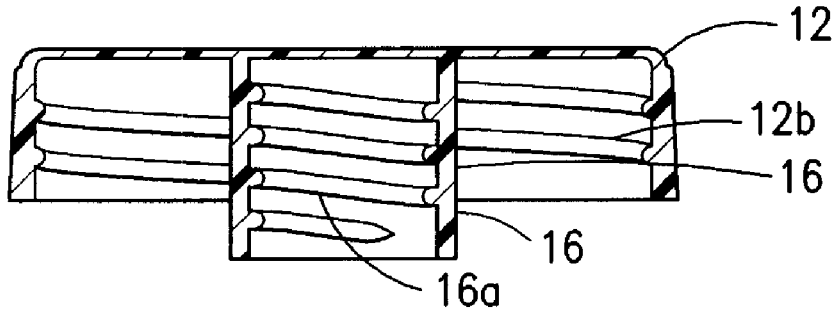
FIG. 5 shows a side elevational view in cross-section of a PC cap in accordance with an embodiment of the invention.

Referring now to FIG. 5, the cap 12 is shown with inner wall 16 molded integrally with the primary container cap body 12 forming an inner wall that is circular that includes threads 16*a*. Also shown are the cap threads 12*a* that are used to seat the cap to a primary container. With respect to FIG. 5 and FIG. 6, note that both embodiments shown the inner wall 16 for the inner fastener extending below the outer rim of the cap 12. With respect to FIG. 6, the inner rim 20 extends in length beyond the outer rim 18 in length.

Figure 6:
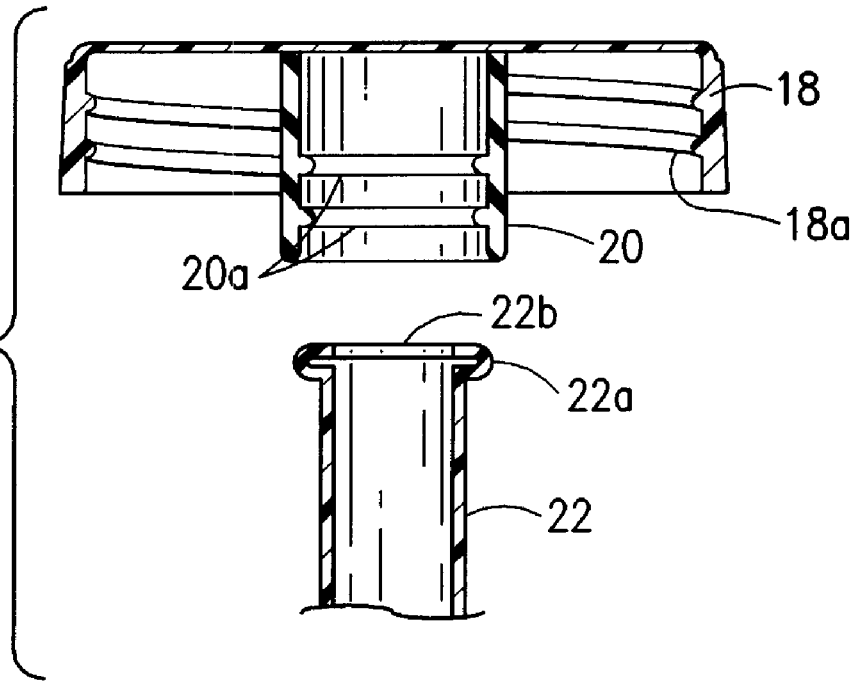
FIG. 6 shows a side elevational view in cross-section, broken away of an alternate embodiment of the invention.

FIG. 6 shows an alternate embodiment. In lieu of the threaded fasteners 14*a* shown on the tubular body 14 in FIG. 1, an inner container tubular body 22 is used that has a single upper annular lip 22*a* around the opening 22*b*. The lip or protrusion 22*a* extends around the entire top opening 22*b* of elongated body 22 and snaps into place into a groove portion formed between annular ridges 20*a* on the inside of the circular wall 20 that is formed part of the bottom inside of the cap 18. Body 20 and rings 20*a* are resilient enough to allow the larger diameter of inner container 22 and especially lip 22*a* to snap into the groove between ridges 20*a*. The diameter of the opening 22*b* including the annular protruding lip 22*a* for body 22 can snap in between circular ridges 20*a* to seal and hold elongated inner container body 22 firmly to the cap 22. Because of the resilient nature of the material used which is preferably a plastic or rubber-like plastic found in many bottle caps, body 22 can easily snap sealably in place to cap 18 in the groove provided between ridges 20*a*.

Other forms of fasteners can be used including a recessed groove with snap-in features in various combinations of recessed and elongated ridges between the upper top opening of the elongated body 22 and the inside wall of the circular wall 20 that allows the body 22 to be sealably, but removably attached to the primary container cap 18.

The elongated tube inner container 14 shown in FIG. 1 or 22 shown in FIG. 6 can be filled with the desired material 11 (FIGS. 1 and 2) which can be liquid, powder or crystal substance that will, ultimately, be mixed with whatever the contents of the primary container at the time of use.

Figure 7:
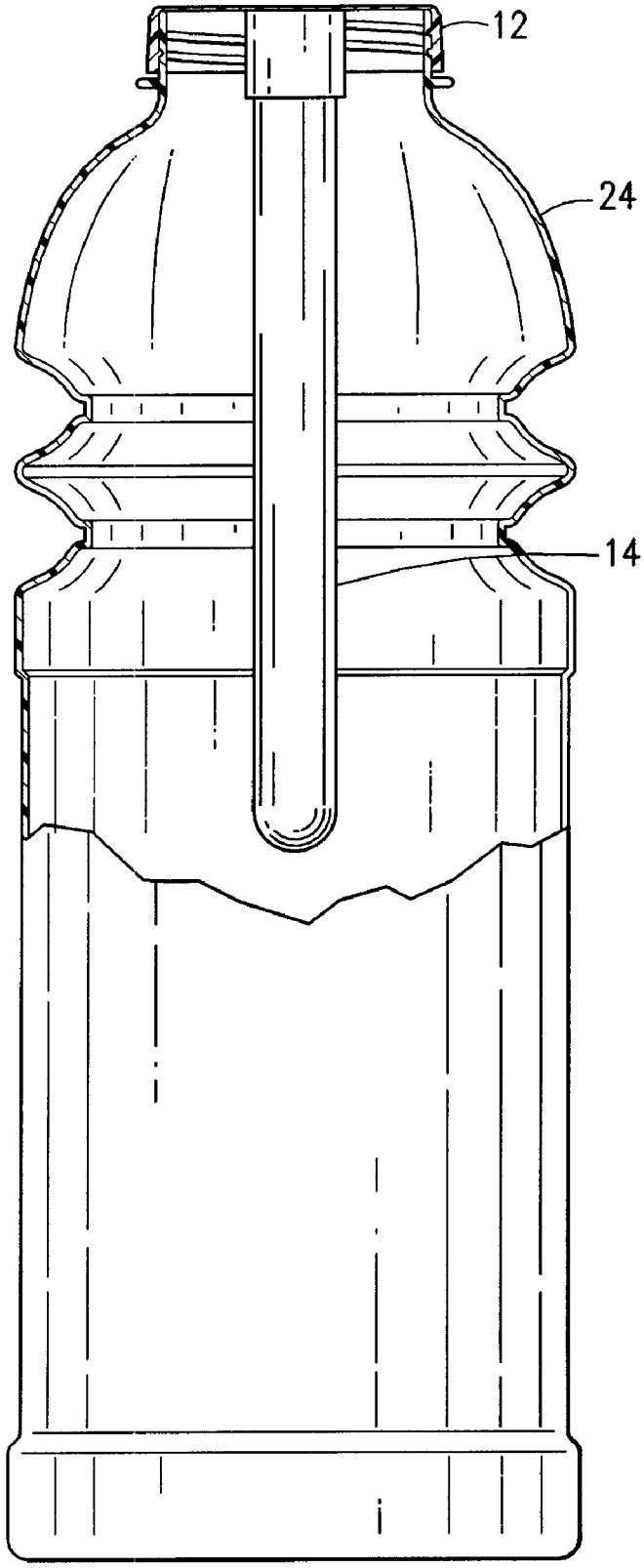
FIG. 7 shows a side elevational view, partially cut away and partially in cross-section showing an embodiment of the connected to a primary container such as a plastic bottle.

In FIG. 7, cap 12 is attached to a representative primary container 24 and inner container 14. The inner container 14 is threadably attached to the cap 12 which is sealed to container 24. The container 24 could be filled with a liquid or powder as is the inner container 14.

In use, first the cap 12 is manually removed from container 24 and the inner container extracted from container 24. A user would then manually unthread elongated body 14 from the cap 12 exposing the contents in the IC through the open top of elongated body 14 so that the contents can be then poured directly into the container 24 for mixing purposes. At this point in time, the inner container 14 can be disposed of. The cap 12 can be used to seal container 24 with its mixed contents.

The ultimate shape and size of inner container 14 can be varied as long as the inner container 14 fits within container 24 or any other suitable primary container. A variety of primary containers can be used that have a variety of removable and sealable caps with a extendable variety of inner containers so that two different chemicals can be mixed at the time of usage.

Referring now to FIG. 8, another alternate embodiment is shown. The primary container cap 12 can have more than one circular wall fastener for two inner containers as shown in FIG. 8. At least two inner wall fasteners 13 and 16 are shown mounted on the inside of a primary container cap 12. Each of the inner walls 13 and 16 has a different size diameter to accommodate two different sized diameter coaxially mounted inner containers. The inner walls 13 and 16 can include threads or snap-in grooves 13*a* and 16*a* that would allow each inner container to be attached to inner wall fastener 13 and 16 depending on its diameter size or even having one inner container inside another inner container both of which can then be mounted inside of a primary container attached to the cap 12.

FIG. 9 shows yet another alternate embodiment. The primary container cap 12 instead of being flat can include a slidable closable nipple 15 on its exterior that allows the user to drink directly from the primary container when the nipple 15 is snapped in an up or open position shown by vertical arrow. In this embodiment, there will be a hole 15*a* through primary container cap 12 that allows the contents of the primary container to flow into the nipple 15 for use by a person drinking out of the primary container. The inner container fastened to wall 16 must be removed before activation of the nipple 15. The inner container contents will be poured into the primary container and the inner container completely removed and discarded. The nipple 15 can then be opened and used to drink the contents from the primary container through apertures 15*a* and 15*b*.

Plug 15*e* blocks aperture 15*b* when nipple 15 is down. Support arms 15*c* and 15*d* are thin and support plug 15*e* to cap body 12 but do not block the contents from a primary container from flowing through apertures 15*a* and 15*b* when the nipple 15 is in the up position.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A container cap comprising:

a cylindrical cap body having a closed top and an open bottom and an annular outside surrounding wall surrounding the top; said cap body having a plurality of threads on the inside of said annular wall for engaging as a fastener with a first container having a substantially same size diameter opening with compatible threads;

said cap body including a coaxial cylinder on the inside bottom of said cap body;

said coaxial cylinder longitudinal length exceeding said cap body outside surrounding wall length, said coaxial cylinder having an annular smooth outside wall and an inside wall containing fastener threads that are sized and shaped to allow the inside wall to be threadably engaged with a second container having a substantially similar diameter and compatible threads, whereby said cap can be used to mount the second container threadably attached to the inside threads within the first container that can be threadably connected with the threads on the side cap wall; and said cap body including a third coaxial cylinder on the inside bottom of said cap body concentrically disposed inside said second cap body coaxial cylinder, said third coaxial cylinder having an annular smooth outside wall and an inside wall containing fastener threads that are sized and shaped to allow the third coaxial cylinder inside wall to be threadably engaged with a third container having a substantially similar diameter and compatible threads, said container cap usable to mount a second container threadably attached to the inside threads within a first container that can be threadably connected with threads on the inside cap wall and a third container coaxially mountable within a second container.

* * * * *